US006361181B1

(12) United States Patent
Bales

(10) Patent No.: US 6,361,181 B1
(45) Date of Patent: Mar. 26, 2002

(54) APPLIANCE WITH LIGHT MOUNTED IN DOOR

(75) Inventor: Michael E. Bales, Cleveland, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/514,276

(22) Filed: Feb. 28, 2000

(51) Int. Cl.[7] ..... F21V 33/00

(52) U.S. Cl. ..... 362/92; 362/125; 362/253; 362/94; 362/155; 126/198

(58) Field of Search ..... 362/92, 125, 253, 362/155, 94; 126/198, 200

(56) References Cited

U.S. PATENT DOCUMENTS

| | | | | |
|---|---|---|---|---|
| 3,387,601 A | * | 6/1968 | Buerki | 126/21 |
| 3,612,825 A | | 10/1971 | Chase et al. | 219/405 |
| 3,659,582 A | | 5/1972 | Morgan | 126/198 |
| 4,363,315 A | | 12/1982 | Von Blanquet | 126/273 R |
| 4,853,508 A | | 8/1989 | Hammerl | 219/758 |
| 4,870,546 A | | 9/1989 | Hammerl et al. | 362/92 |
| 5,699,676 A | * | 12/1997 | Trulaske | 62/264 |
| 6,059,420 A | * | 5/2000 | Rogers | 362/92 |

* cited by examiner

*Primary Examiner*—Sandra O'Shea
*Assistant Examiner*—Ali Alavi
(74) *Attorney, Agent, or Firm*—Everett G. Diederiks, Jr.

(57) ABSTRACT

An appliance, such as an oven, including a cavity adapted to receive food items has an open frontal portion which can be closed off by means of a pivotable door. The door is provided with a transparent zone which enables viewing of the cavity when the door is closed. Mounted within the door is a lighting device which can be used to selectively illuminate the cavity. Preferably, the transparent zone is defined by a window pack assembly including a pair of spaced first and second transparent panels between which is arranged the lighting device such that the lighting device illuminates the cavity through one of the transparent panels. Wires are directed to the lighting device through the door, while entering a cabinet of the appliance adjacent a hinge axis area associated with the door.

19 Claims, 2 Drawing Sheets

APPLIANCE WITH LIGHT MOUNTED IN DOOR

BACKGROUND OF THE INVENTION

1. Field of the Invention

The present invention pertains to the art of appliances and, more specifically, to the incorporation of a lighting unit in an access door for an appliance, particularly in a door incorporating a window unit which enables viewing of an interior of the appliance without opening of the door.

2. Discussion of the Prior Art

In the art of appliances, such as cooking appliances taking the form of ranges or wall units, it is common to provide a window unit in an oven door of the appliance in order to enable food being cooked to be examined without opening the door and losing a considerable amount of heat. In accordance with many known arrangements, the window units incorporate spaced, substantially parallel, transparent plates which are mounted within the door as a unit or pack. In general, these transparent panels can be clear or tinted.

It is also common to provide a light within a cavity of the appliance which can be selectively activated in order to illuminate the cavity for enhanced viewing. That is, when the door is closed, the cavity will often be quite dark and examining the food being cooked through the window unit requires the cavity to first be illuminated. In the prior art, such lighting arrangements have been mounted to either the top, rear or side walls of the oven cavity and wired to a button or switch for controlling the activation of the light. Even in cooking appliances incorporating ovens which do not have window units, lights are still often provided, with the lights being automatically activated upon opening of an oven door.

Because of the extreme temperatures which can be developed in an oven cavity during operation of a cooking appliance, particularly if the appliance incorporates a self-cleaning feature, provisions must be made to protect the wiring and other heat sensitive elements of the lighting unit from being damaged during operation of the appliance. Furthermore, mounting a lighting unit within the oven cavity requires a hole to be formed in at least one wall of the cavity, thereby altering the overall integrity of the cavity and possibly providing a unintended escape zone for heat generated within the cavity.

Although these problems particularly exist in relation to oven cavities, it would also be desirable to illuminate other types of appliance cavities as well. In any event, based on the above, there exists a need in the art of appliances for a lighting arrangement for use in illuminating a cavity of the appliance, yet will enable the integrity of the cavity to be maintained and will assure that all the components of the lighting unit will not be exposed to possible damaging conditions, particularly in the case of exposure to heat in connection with a lighting unit for an oven cavity.

SUMMARY OF THE INVENTION

The present invention is directed to illuminating an interior cavity of an appliance. More particularly, the appliance includes an interior cavity having an open frontal portion and a door which is movable between an open position for accessing the interior cavity and a closed position for essentially sealing off the cavity. The door is provided with a window unit which permits viewing of the cavity when the door is closed. In order to enable food items to be viewed through the window unit, a lighting device is carried by the door for illuminating the cavity.

In accordance with a preferred embodiment of the invention, the appliance constitutes an oven having a door in which is mounted a multi-panel window pack assembly and a lighting device positioned between the panels. The lighting device incorporates a bulb which is arranged within a housing that directs the output from the bulb through a portion of the window pack and into the oven cavity. Power is delivered to the lighting device by routing wires within the door to a location directly adjacent the hinge axis for the door and then to the shell portion of the appliance.

With this construction, the wires and other potentially heat sensitive elements of the lighting device are isolated from the heat generated within the oven cavity during operation of the appliance. In addition, this arrangement simplifies the overall assembly of the appliance as the lighting device can be incorporated as part of a window pack mounted between inner and outer panels of the door. Integrating the lighting device with the window pack simplifies the overall assembly process, thereby reducing overall assembly costs.

Additional objects, features and advantages of the present invention will become more readily apparent from the following detailed description of the preferred embodiment thereof when taken in conjunction with the drawings wherein like reference numerals refer to corresponding parts in the several views.

DETAILED DESCRIPTION OF THE PREFERRED EMBODIMENT

Figure 1:
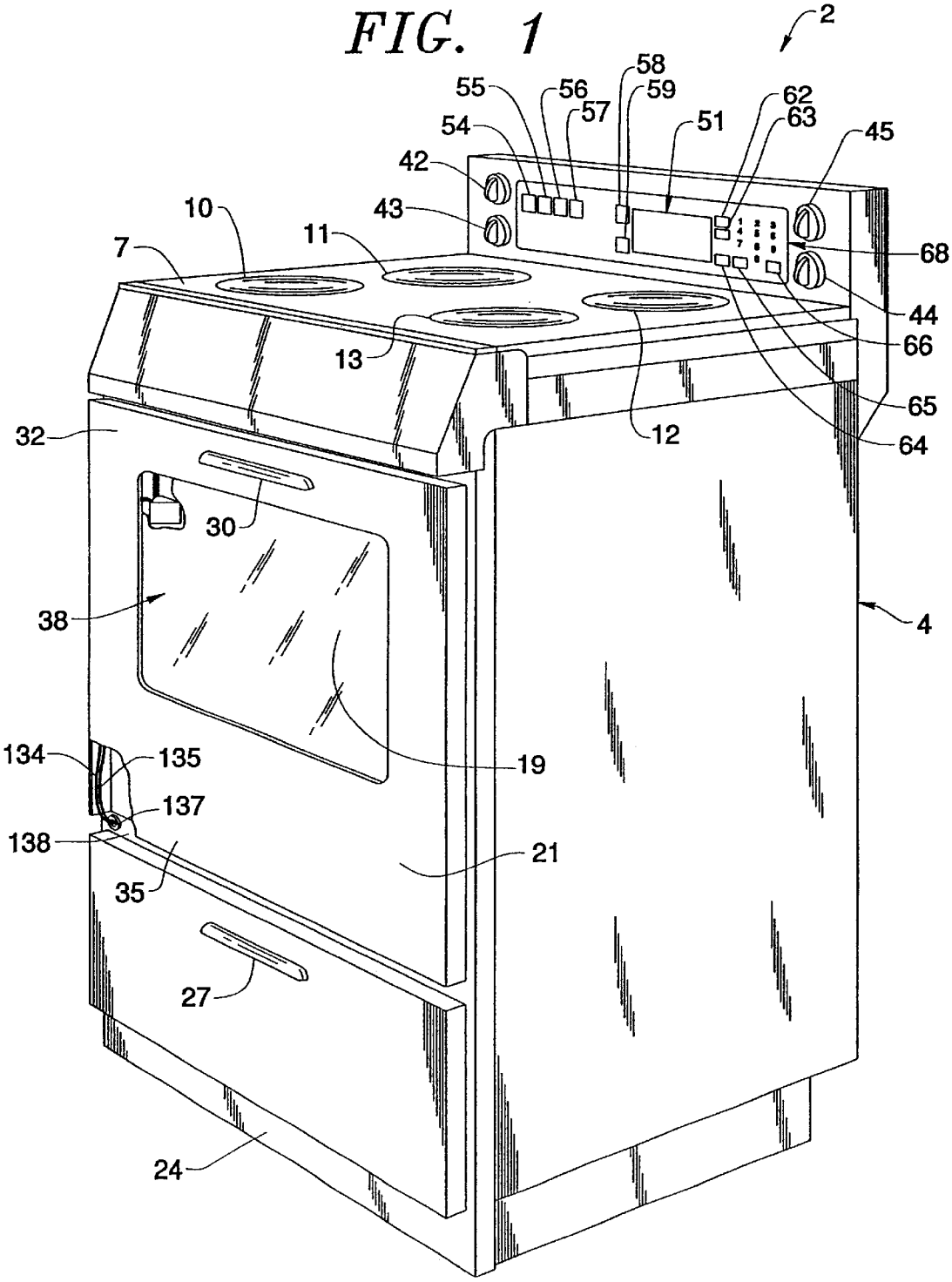
FIG. 1 is a perspective view of an oven range incorporating a door mounted light arrangement in accordance with the present invention.

With initial reference to FIG. 1, a cooking appliance 2, generally taking the form of an oven range, includes a cabinet shell 4 provided with a cooktop 7. As illustrated, appliance 2 constitutes an electric oven such that cooktop 7 is provided with a plurality of electric heating elements 10—13. At this point, it should be noted that although appliance 2 is shown to constitute an electric range, the invention is equally applicable to various other types of appliances, including gas ranges, microwave ovens, wall ovens and the like.

In a manner known in the art, appliance 2 includes a control panel 16, an interior oven cavity 19 having an associated door 21, and a lower drawer or bin 24. More specifically, drawer or bin 24 is provided with a handle 27 and is adapted to be slid into and out of shell 4, with bin 24 defining in order to access an interior storage compartment (not shown) therein. Door 21 is also provided with a handle 30 at an upper portion 32 thereof. Door 21 is adapted to pivot at a lower portion 35 to enable selective access to within oven cavity 19. In a manner also known in the art, door 21 is provided with a transparent zone 38 for viewing oven cavity 19 while door 21 is closed as will be discussed more fully below.

Also shown for the sake of completeness, control panel 16 includes a plurality of control knobs 42–45 for use in selectively activating and deactivating heating elements 10–13 respectively. In accordance with the most preferred embodiment of the invention, the heating of oven cavity 19 is electronically controlled such that control panel 16 includes a display zone 51, as well as a set of control buttons 54–57 which enable a desired bake, broil, clean or keep warm operation to be established. In addition, an operational mode cancel button 58, as well as a light activation button 59, is provided on one side of display zone 51. On the opposing side of display zone 51, there is provided a operating set button 62, a timer button 63, cook and stop time buttons 64 and 65, a clock button 66 and a number pad 68.

Figure 2:
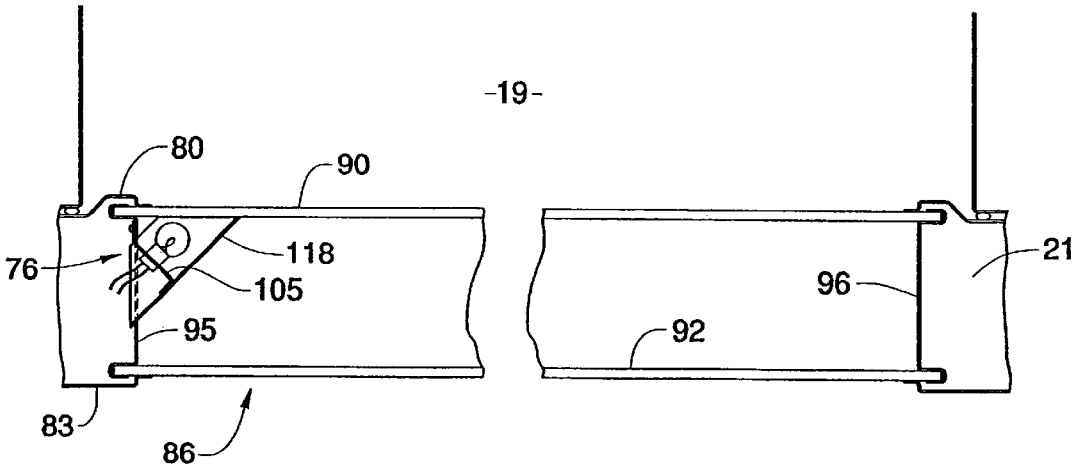
FIG. 2 is a top, partial sectional view of a door and cavity forming part of the oven range of FIG. 1.
Figure 3:
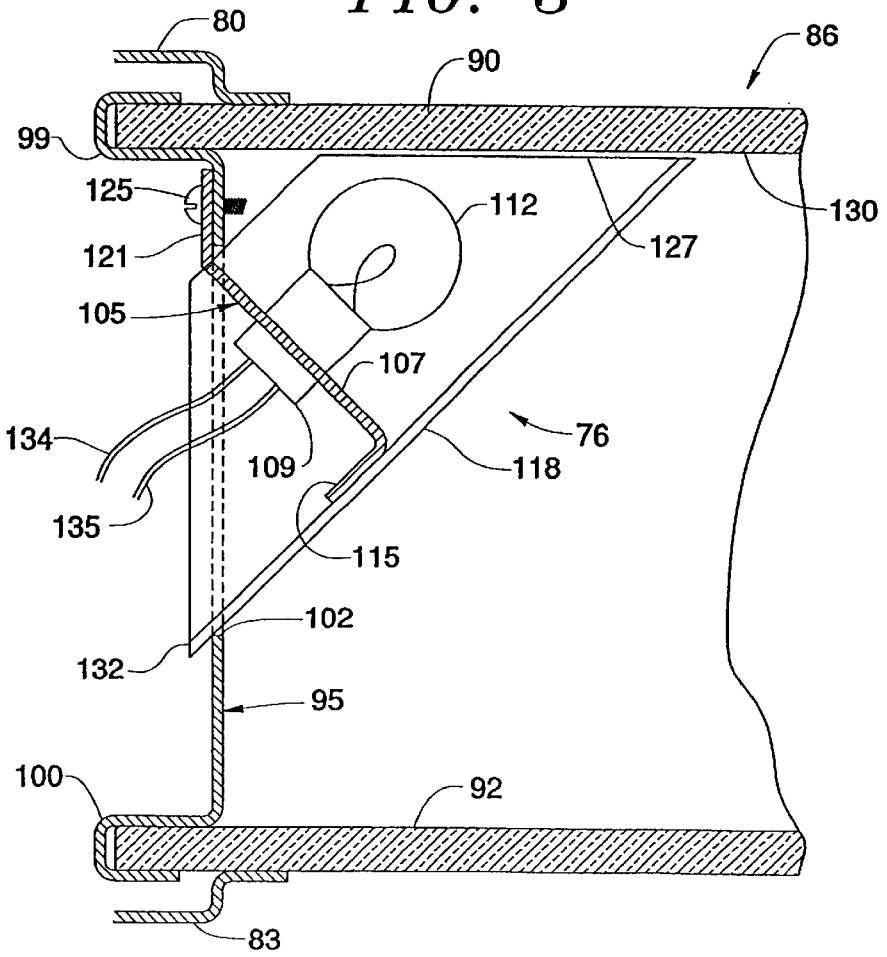
FIG. 3 is an enlarged, partial cross-sectional view of a portion of the door and cavity shown in FIG. 2.

In general, the above-described structure of appliance 2 is known in the art and is only provided here for the sake of completeness. The present invention is particularly directed to the incorporation of a lighting device 76 within door 21. Reference will now be made to FIGS. 1–3 in describing the preferred construction and mounting of lighting device 76. As shown, door 21 includes an inner panel 80 and an outer panel 83 which are connected together with a window pack assembly 86 arranged therebetween. Window pack assembly 86 includes a first transparent panel 90 and a second transparent panel 92 which are interconnected by a plurality of brackets, two of which are indicated at laterally spaced positions at 95 and 96. As shown, each bracket 95, 96 includes bent, generally U-shaped end portions 99 and 100 which receive side portions (not separately labeled) of first and second transparent panels 90 and 92 respectively. In this manner, first and second transparent panels 90 and 92 can be interconnected prior to assembly within door 21 such that window pack assembly 86 is preassembled and mounted within door 21 as a integrated unit. As will become more evident below, it is preferable to integrate lighting device 76 into window pack assembly 86 as well.

In the most preferred embodiment of the invention, interconnecting bracket 95 is provided with an opening 102 into which extends lighting device 76. Lighting device 76 includes a light mounting bracket 105 having a central section 107 to which is secured a bulb housing 109 that carries a bulb 112. Light mounting bracket 105 also includes a first angled end 115 that is attached to a light directing housing 118, as well as a second angled end 121 that is secured to bracket 95 by means of one or more threaded fasteners 125.

As perhaps best shown in FIG. 3, housing 118 includes a first end 127 which extends to directly adjacent an inner surface 130 of first transparent panel 90, as well as a second end 132 which projects through opening 102. First end 127 is opened such that light illuminating from bulb 112 is directed through first transparent panel 90 into oven cavity 19 when door 21 is closed. Most preferably, housing 118 and central section 107 of light mounting bracket 105 have light reflecting surfaces which direct the light emitted from bulb 112 in the desired direction, i.e., into cavity 19. The mounting of housing 118 between first and second transparent panels 90 and 92 is enhanced by having second end 132 of housing 118 project through opening 102. Therefore, this overall mounting arrangement limits the movement of housing 118 relative to the remainder of window pack assembly 86.

Based on the above description, it should be readily apparent that the activation of lighting device 76 will cause cavity 19 to be illuminated through first transparent panel 90. Since lighting device 76 is located behind first transparent panel 90, it is not directly subjected to the extreme heat which can be developed within oven cavity 19 and, in fact, is insulated from this heat by first transparent panel 90. Secondly, since housing 118 of lighting device 76 is secured to bracket 95, lighting device 76 is integrated with window pack assembly 86 to ease the mounting of the overall arrangement within door 21. In the preferred embodiment shown, lighting device 76 is mounted in an upper left comer of window pack assembly 86, but this position could be readily changed without departing from the invention.

As also shown, bulb housing 109 has a pair of wires 134 and 135 extending therefrom. Given that window pack assembly 86 is arranged between inner and outer panels 80 and 83 of door 21, wires 134 and 135 can be readily routed within door 21 and then into shell 4. More specifically, wires 134 and 135 are routed downwardly within door 21 and enter shell 4 through an aperture 137 formed in a crosspiece 138 as clearly shown in FIG. 1. In a manner known in the art, crosspiece 138 generally extends along a pivot axis for door 21. Therefore, wires 134 and 135 enter cabinet shell 4 of the appliance 2 generally along or directly adjacent this pivot axis. With this arrangement, a minimum amount of slack is required for wires 134 and 135 and the opening and closing of door 21 is not hampered by the incorporation of lighting unit 76 therein. Of course, a wireless lighting device could also be utilized, but this is not the preferred embodiment.

Based on the above, it should be readily apparent that lighting device 76 can be readily incorporated into appliance 2 during the assembly step for window pack assembly 76. In addition, lighting device 76 can function to illuminate oven cavity 9 upon engagement of button 59. In any event, although described with respect to a preferred embodiment of the invention, it should be readily understood that various changes and/or modifications can be made to the invention without departing from the spirit thereof. For instance, although lighting device 76 has been shown to be incorporated between first and second transparent panels 90 and 92, it should be readily apparent that lighting device 76 could be provided at other locations within door 21, such as above, below or to the side of transparent zone 38, while enabling light generated by bulb 112 to be directed into cavity 19. In addition, lighting device 76 preferably utilizes an incandescent bulb 112, but it should be understood that various other types of lighting devices could also be readily utilized, including fluorescent, fiber optics and the like, without departing from the spirit of the invention. In general, the invention is only intended to be limited by the scope of the following claims.

I claim:

1. In an appliance including an interior cavity having an open frontal portion adapted to receive food items and a door mounted for pivotal movement between an opened position, wherein access to within the cavity is permitted, and a closed position, wherein the door extends across the open frontal portion, a cavity viewing assembly comprising:

a window unit mounted to the door for permitting viewing of the cavity when the door is in the closed position, said window unit including first and second, spaced transparent panels; and a lighting device for illuminating the cavity, first through the first transparent panel, then into the cavity.

2. The cavity viewing assembly according to claim 1, wherein the lighting device is mounted within the door.

3. The cavity viewing assembly according to claim 1, wherein the appliance comprises an oven and the cavity constitutes an oven cavity.

4. The cavity viewing assembly according to claim 1, wherein the door includes an inner panel and an outer panel, said first transparent panel being located closer to the inner panel than the outer panel.

5. The cavity viewing assembly according to claim 4, wherein said lighting device is located between the first and second transparent panels.

6. The cavity viewing assembly according to claim 5, wherein the first and second transparent panels are integrated into a window pack assembly and the lighting device is directly attached to the window pack assembly.

7. The cavity viewing assembly according to claim 6, wherein the lighting device includes a light directing housing secured to the window pack assembly.

8. The cavity viewing assembly according to claim 7, wherein a portion of the light directing housing projects out of the window pack assembly.

9. The cavity viewing assembly according to claim 2, wherein said lighting device receives power through a plurality of wires which are routed through the door.

10. The cavity viewing assembly according to claim 9, wherein the door is hinged about a substantially horizontal axis and the appliance includes a cabinet shell, said wires exiting the door and entering the cabinet shell directly adjacent the horizontal axis.

11. A cooking appliance comprising:

an oven cavity including an interior portion, adapted to receive food items to be cooked, and an open frontal portion;

a door mounted for movement between an open position, wherein access to within the cavity is permitted through the open frontal portion, and a closed position, wherein the door extends across the open frontal portion;

a window unit mounted to the door, said window unit permitting viewing of the cavity when the door assumes the closed position; and a lighting device for illuminating the cavity, said lighting device being attached within the window unit for movement in unison with the door.

12. The cooking appliance according to claim 11, wherein the window unit includes a first transparent panel, said lighting device illuminating the cavity through the first transparent panel.

13. The cooking appliance according to claim 12, wherein the door includes an inner panel and an outer panel, said first transparent panel being located closer to the inner panel than the outer panel.

14. The appliance according to claim 11, wherein said lighting device receives power through a plurality of wires which are rotated through the door.

15. An appliance comprising:

a cavity including an interior portion, adapted to receive food items, and an open frontal portion;

a door mounted for movement between an open position, wherein access to within the cavity is permitted through the open frontal portion, and a closed position, wherein the door extends across the open frontal portion, said door including an inner panel and an outer panel;

a window unit mounted to the door, said window unit permitting viewing of the cavity when the door assumes the closed position, wherein the window unit includes a first transparent panel, which is located closer to the inner panel than the outer panel, and a second transparent panel which is spaced from the first transparent panel; and a lighting device for illuminating the cavity, said lighting device being attached to the door for movement in unison with the door and located between the first and second transparent panels for illuminating the cavity through the first transparent panel.

16. The appliance according to claim 15, wherein the first and second transparent panels are integrated into a window pack assembly and the lighting device is directly attached to the window pack assembly.

17. The appliance according to claim 16, wherein the lighting device includes a light directing housing secured to the window pack assembly.

18. The appliance according to claim 15, wherein the appliance comprises an oven and the cavity constitutes an oven cavity.

19. The appliance according to claim 11, wherein the door is hinged about a substantially horizontal axis and the appliance includes a cabinet shell, said wires exiting the door and entering the cabinet shell directly adjacent the horizontal axis.

* * * * *